US006059204A

United States Patent [19]

Augustin

[11] Patent Number: 6,059,204

[45] Date of Patent: May 9, 2000

[54] ACCUMULATOR INJECTION SYSTEM

[75] Inventor: Ulrich Augustin, Kernen, Germany

[73] Assignee: DaimlerChrysler AG, Stuttgart, Germany

[21] Appl. No.: 09/215,762

[22] Filed: Dec. 19, 1998

[30] Foreign Application Priority Data

Dec. 20, 1997 [DE] Germany ..... 197 56 986

[51] Int. Cl.[7] ..... F02M 45/00

[52] U.S. Cl. ..... 239/533.4; 239/533.8

[58] Field of Search ..... 239/88, 91, 533.4, 239/533.8, 579, 124, 127

[56] References Cited

U.S. PATENT DOCUMENTS 5,402,760 4/1995 Takeuchi et al. .
5,526,791 6/1996 Timmer et al. .

FOREIGN PATENT DOCUMENTS 196 12 738 10/1996 Germany .
2 322 414 8/1998 United Kingdom .

*Primary Examiner*—Kevin Weldon
*Attorney, Agent, or Firm*—Klaus J. Bach

[57] ABSTRACT

An accumulator fuel injection system for a multi-cylinder internal combustion engine with solenoid controlled fuel injection valves each including a spring loaded fuel injection nozzle needle to which fuel under pressure is supplied under the control of a solenoid controlled piston with a valve structure at one end for controlling fuel supply to the nozzle needle, the control piston has at its end an axial projection extending into a fuel supply cavity to restrict the fuel passage from the fuel supply cavity through the valve structure to the nozzle needle upon initial lifting of the control piston but permitting unrestricted flow after a predetermined lifting stroke, that is, solenoid energization period, and the solenoid is energized by a first energization pulse of a duration $t_1$ and, after an interruption period $t_2$ by a main energization pulse $t_2$ during which the control piston is fully lifted for unrestricted fuel flow to the nozzle needle.

4 Claims, 2 Drawing Sheets

ACCUMULATOR INJECTION SYSTEM

The invention relates to an accumulator fuel injection system for a multi-cylinder internal combustion engine with magnetic valve controlled direct fuel injection valves.

Such an accumulator injection system is known from DE 196 12 738 A1. The control piston with integrated valve is guided herein in two casing components and is in communication with the rear of the nozzle needle via a spring chamber. The valve is formed by an annular conical seat face, which projects from the control piston into an intermediate space and has an adapted conical valve seat on a casing component.

U.S. Pat. No. 5,402,760 describes an injection control device, wherein the fuel injection may take place in various forms using different injection quantities and with different interruptions with pre-injections.

U.S. Pat. No. 5,402,760 describes an injection control device, an injection being proposed in various forms with different injection quantities and with different interruptions in the form of pre-injections.

U.S. Pat. No. 5,526,791 discloses an injection device with a control piston, which is guided in a housing component and a spring-loaded nozzle needle, which is spatially separated from the control piston.

It is the object of the present invention to provide an accumulator injection system of the type referred to above by which the injection profile can be controlled, the overall efficiency of the injection system can be improved, and the injection profile during the injection period and the end of the injection can be controlled independently from one another.

SUMMARY OF THE INVENTION

An accumulator fuel injection system for a multi-cylinder internal combustion engine with solenoid controlled fuel injection valves each including a spring loaded fuel injection nozzle needle to which fuel under pressure is supplied under the control of a solenoid controlled piston with a valve structure at one end for controlling fuel supply to the nozzle needle, the control piston has at its end an axial projection extending into a fuel supply cavity to restrict the fuel passage from the fuel supply cavity through the valve structure to the nozzle needle upon initial lifting of the control piston but permitting unrestricted flow after a predetermined lifting stroke, that is, solenoid energization period, and the solenoid is energized by a first energization pulse of a duration $t_1$ and, after an interruption period $t_2$ by a main energization pulse $t_2$ during which the control piston is fully lifted for unrestricted fuel flow to the nozzle needle.

The spatial separation of the control piston and nozzle needle avoids persistent leakage from the high pressure inlet to the spring space, whereby the overall efficiency of the accumulator injection system can be improved.

The throttle pin on the control piston enables a desired injection profile to be specified at the start of the injection, making it possible, for example, to achieve a slow rise in combustion pressure in the engine, which thus also leads to a reduction in emissions of noxious emissions.

By controlling the control piston with an intermediate closing period in the manner according to the invention, it is, furthermore, possible to control the injection period and the end of injection independently. In this way, the profile of the fuel injection can be made significantly more gentle so as to provide for a relatively slow increase in combustion pressure. At the same time, such control does not negatively affect the end of the injection itself; at the end of the injection period, the injection pressure should drop suddenly to terminate the injection of fuel as quickly as possible.

The accumulator injection system according to the invention also improves the closing of the nozzle needle.

If the individual injection times and the intermediate period are made variable, the injection profile can be influenced and/or controlled over a wide range. In this way it becomes possible to implement an individual injection profile shaping for each operating point of the internal combustion engine and thus achieve optimum operating conditions for the lowest possible emissions of noxious substances and for favourable fuel consumption.

Advantages of the invention will become apparent from the exemplary embodiments, which are described in principle below with reference to the drawing.

DESCRIPTION OF PREFERRED EMBODIMENTS

A fuel injection valve 1 for direct fuel injection for accumulator injection systems of multi-cylinder internal combustion engines, which operate according to the common-rail principle, is controlled by a solenoid valve. The fuel injection valve 1 includes a spring-loaded nozzle needle 2 and a control piston 3, which is spatially separated from the latter and has an integrated valve 4.

Figure 1:
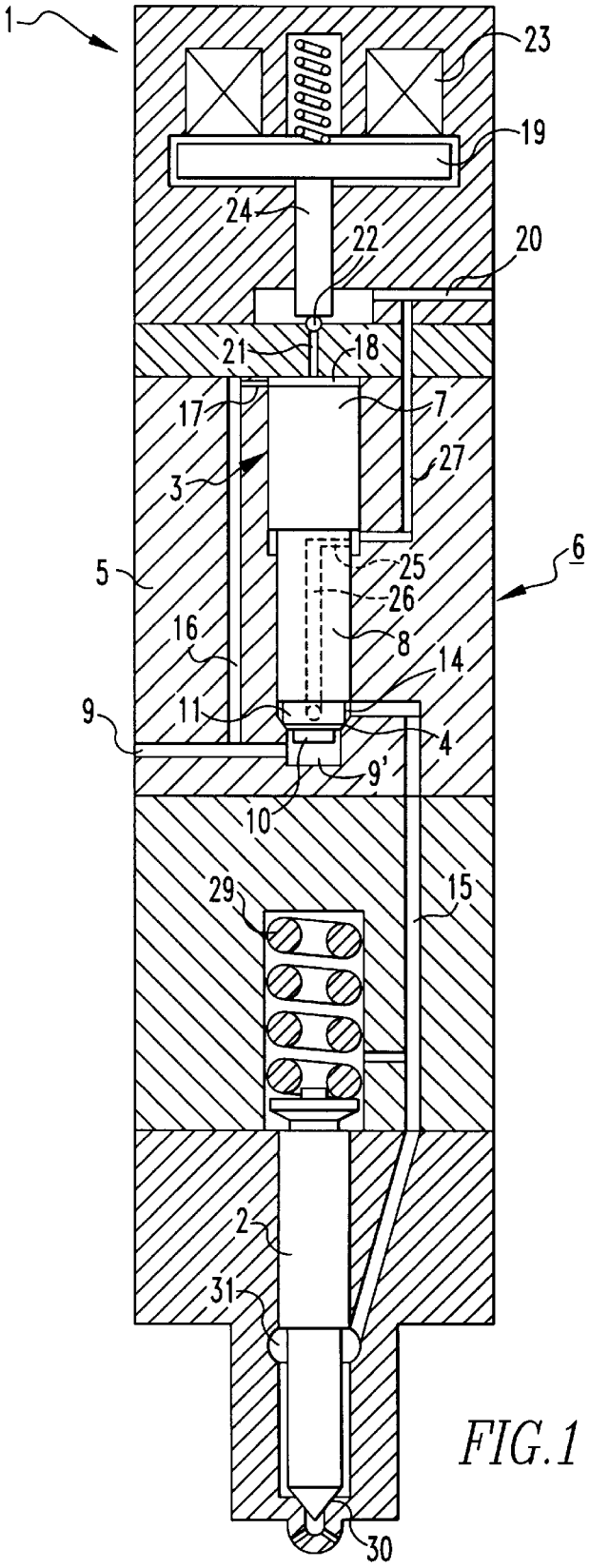
FIG. 1 shows a fuel injection valve according to the invention having a two-part control piston.

As is shown in FIG. 1, the control piston 3 is of two-part design and is longitudinally displaceably guided in a casing part 5 of the valve casing 6. The control piston 3 thus has an upper piston part 7 and a lower piston part 8. The upper piston part 7 is larger in its diameter than the lower piston part 8. The lower piston part 8 is provided at its valve-side piston end with a throttle pin 10 which can move out of an inlet cavity 9'. The lower piston component 8 has, in its lower region in which it acts as a valve 4, a portion of reduced diameter 11 at whose lower end the throttle pin 10 is arranged. The portion of reduced diameter 11 has a conical valve seat 12 (FIG. 2), which is matched to a conical seat face 13 in the casing component 5. The portion of reduced diameter 11 of the piston part 8 bounds an annular space 14, which is formed between the valve seat 12 and the portion of reduced diameter 11. A fuel supply passage 15 extends from the annular space 14 to the nozzle needle 2.

The inflow passage 9, which is connected to a high-pressure accumulator (common rail) which is not illustrated, is in communication, via a connecting passage 16 and a throttle 17, with a control space 18 at the rear of the control piston 3. The control piston 3 is subject to system pressure in the control space 18 as long as a solenoid valve 19 keeps a relief passage 20 closed. Fluid release by way of a throttle passage 21 with a shut-off element 22 is prevented when the shut-off element 22 presses, in the non-energized state of the solenoid valve 19, on an outlet opening of the throttle passage 21 by means of a pin 24 connected to an armature 23 of the solenoid valve 19. The shut-off element 22 cannot lift off its seat, and thus provide for a communication between the control space 18 and the relief passage 20, until the solenoid valve 19 is energized.

With its upper piston part 7, the control piston 3 which is of two-component design presses the lower piston part 8 onto its valve seat 12 and interrupts the high-pressure connection from the inflow passage 9 to the nozzle needle 2 via the feed line 15.

The annular space 14 is pressure-relieved by means of a return flow passage 26, which extends in the interior of the lower piston part 8 and includes a throttle structure 25. The return flow passage 26 is connected to the relief passage 20 via a line 27.

Figure 2:
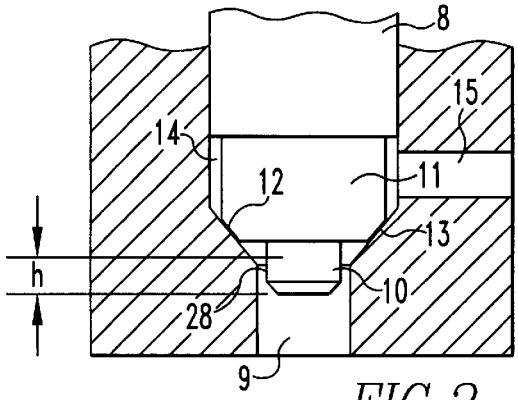
FIG. 2 is an enlarged view of the lower part of the control piston having a throttle pin according to the invention.

FIG. 2 is an enlarged view of the throttle pin 10 with the adjacent components. As is apparent, the throttle pin 10 has a cylindrical shape and projects into the circular inlet cavity 9'. The throttle pin 10 has a smaller diameter than the inlet cavity 9', thus forming an annular space 28, which determines the passage of fuel.

Figure 3:
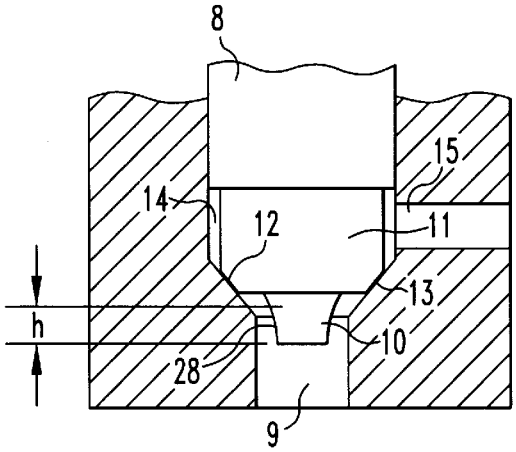
FIG. 3 shows another embodiment of the throttle pin.

FIG. 3 illustrates another embodiment of the throttle pin 10. As is shown, the latter is conical and/or tapers towards the end of the pin, as a result of which the flow cross-section 28 depends on the position of the throttle pin 10.

As soon as the solenoid valve 19 is energized. The pressure in the control space 18 above the control piston 3 is released whereby the valve 4 is opened by to the pressure forces on the piston part 8 at the valve seat 12. As a result, the inlet cavity 9' is placed into communication with the nozzle needle 2 via the fuel supply passage 15. The nozzle needle 2 lifts off from its valve seat 30 against the force of a closing spring 29.

The valve lift, designated by h, of the control piston 3 is selected to be greater than the needle lift of the nozzle needle 2. This long valve lift h makes it possible to provide for a progressively increasing passage cross-section during the opening phase owing to the design of the lower piston part 8 which has a portion of reduced diameter 11 and the throttle pin 10 projecting therefrom. The opening cross section which determines the flow passage at the beginning is, depending on requirements, obtained in accordance with the exemplary embodiment according to FIG. 2 or FIG. 3 with the throttle pin 10 having a shape as illustrated therein. As a result of the given cross-sectional profile, initially an annular nozzle space 31, which surrounds the nozzle needle 2 and which adjoins the fuel supply passage 15, is relatively slowly filled so that the injection rate rises slowly at the start of the injection. As soon as the throttle pin 10 emerges from the inflow cavity 9', the entire flow cross section of the cavity 9' is cleared.

Figure 4A:
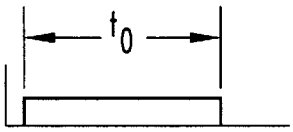
FIG.4a PRIOR ART
FIGS. 4*a*–4*c* shows a profile of the an energization signal for an injection valve according to the prior art.
Figure 4B:
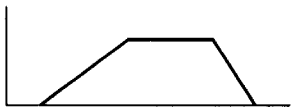
FIG.4b PRIOR ART
Figure 4C:
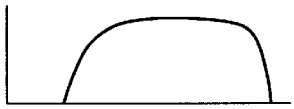
FIG.4c PRIOR ART

FIG. 4 shows the control of the injection valve while the solenoid valve 19 is energized in a customary way. As is shown, the curve a describes a single electrical control signal of the duration $t_0$. This control signal produces a curve b which represents the movement of the control piston 3 during an injection period. The curve c represents the associated injection profile. The front edge of the injection profile is determined by the lifting speed of the control piston 3 and the cross-sectional conditions in the region of the throttle pin 10.

Figure 5A:
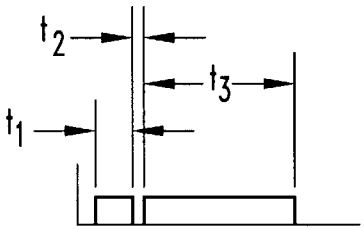
FIGS. 5*a*–5*c* shows the energization signal profile according to the invention for a fuel injection using a first control method.
Figure 5B:
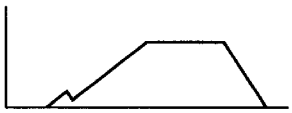
Figure 5C:
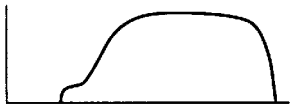

FIG. 5 shows an interrupted energization of electrical solenoid valve 19. Here, the first energization pulse has a duration $t_1$, and after an energization interruption period $t_2$ the main energization pulse with the period $t_3$ follows. As is apparent from the curve b, which illustrates the movement of the control piston 2, the pulse interruption leads to a brief backward movement of the control piston 3, bringing about an injection profile which is illustrated in curve c and which shows a significantly flatter increase in the initial phase. As is apparent, the end of the injection is, however, not influenced by this measure.

Figure 6A:
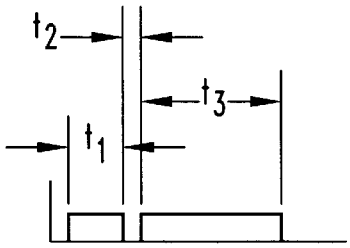
FIGS. 6*a*–6*c* shows the energization signal profile according to the invention for a fuel injection using a second control method.
Figure 6B:
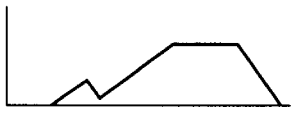
Figure 6C:
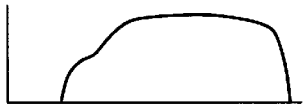

FIG. 6(*a,b,c*) shows basically the same control profile, only the interruption period $t_2$ having been lengthened. As is apparent, the injection period can be varied with a reduced injection quantity over a wide range by independently controlling the pulse period $t_1$, and in particular of the interval period $t_2$. As a rule, the pulse period $t_1$ is selected here to be shorter than the main pulse period $t_3$.

Generally, the valve and/or the throttle pin will be designed in such a way that the first throttled lift phase is very short, since otherwise it may not be possible to implement any compact injection profiles.

What is claimed is:

1. An accumulator fuel injection system for a multi-cylinder internal combustion engine including solenoid-controlled fuel injection valves, each having a casing including a spring loaded nozzle needle with a reduced diameter seat end for closing said injection valve, a control piston movably disposed in said casing in spatially separated relationship from said nozzle needle and having a valve structure integrally formed at one end thereof with a throttle pin axially extending from said one end of said control piston, a fuel inlet cavity formed in said housing at said one end of said control piston so as to receive said throttle pin, a fuel inlet passage leading to said inlet cavity for supplying fuel under pressure to said inlet cavity, a fuel supply passage extending through said valve structure to an annular space surrounding the seat end of said nozzle needle for supplying fuel under pressure to the annular space when said control piston is unseated to open said fuel inlet passage for admitting fuel under pressure to said fuel supply passage to lift said nozzle needle and discharge fuel from said fuel injection valve, said control piston having, at said control piston end opposite said valve structure, a control space in communication with said high pressure fuel supply passage and including a throttle to limit high pressure fuel supply to said control space, a relief passage with a solenoid controlled valve for releasing fuel from said control space for lifting said control piston to open said fuel inlet passage, said throttle pin having a portion extending into said fuel inlet cavity for limiting fuel passage through said valve structure during initial lifting of said control piston, but permitting unrestricted flow of fuel after a predetermined lift movement of said control piston.

2. An accumulator fuel injection system according to claim 1, wherein said pulse period $t_1$, said interruption period $t_2$ and said main pulse period $t_3$ are variably controllable.

3. An accumulator fuel injection system according to claim 1, wherein said pulse period $t_1$ is shorter than said main pulse period $t_3$.

4. An accumulator fuel injection system according to claim 1, including a control arrangement for energizing said solenoid first by a short energization pulse of a period $t_1$ and, after an interruption period $t_2$, by a main energization pulse for a period $t_3$ during which the control piston is fully lifted and unrestricted fuel flow to said nozzle needle is established.

* * * * *